United States Patent [19]

Sugasawa

[11] 4,411,228

[45] Oct. 25, 1983

[54] SPLIT TYPE INTERNAL COMBUSTION ENGINE

[75] Inventor: Fukashi Sugasawa, Yokohama, Japan

[73] Assignee: Nissan Motor Co., Ltd., Kanagawa, Japan

[21] Appl. No.: 209,969

[22] Filed: Nov. 24, 1980

[30] Foreign Application Priority Data

Nov. 27, 1979 [JP] Japan ..... 54-153440

[51] Int. Cl.[3] ..... F02D 17/00

[52] U.S. Cl. ..... 123/198 F; 123/568; 123/481

[58] Field of Search ..... 123/198 F, 568, 481

[56] References Cited

U.S. PATENT DOCUMENTS

| | | | |
|---|---|---|---|
| 4,249,374 | 2/1981 | Sugasawa et al. | 123/198 F |
| 4,313,406 | 2/1982 | Lizuka et al. | 123/198 F |
| 4,316,438 | 2/1982 | Lizuka | 123/198 F |
| 4,320,726 | 3/1982 | Etoh et al. | 123/198 F |
| 4,337,740 | 7/1982 | Sugasawa et al. | 123/198 F |

FOREIGN PATENT DOCUMENTS 2900953 7/1979 Fed. Rep. of Germany .

OTHER PUBLICATIONS

Automobiltechnische Zeitschrift 81, (1979) 6, pp. 255 to 260.

"Entwicklungslinien in Kraftfahrzeugtechnik und Strassenverkehr", Bad Dürrheim, Oct. 15–17, 1979, pp. 556–568.

*Primary Examiner*—Ira S. Lazarus

*Attorney, Agent, or Firm*—Schwartz, Jeffery, Schwaab, Mack, Blumenthal & Koch

[57] ABSTRACT

An internal combustion engine is disclosed which comprises first and second cylinder units each including at least one cylinder, an intake manifold divided into first and second intake passages leading to the first and second cylinder units, respectively, and an exhaust passage leading from the first and second cylinder units. The second intake passage has therein a normally open stop valve. The second intake passage is connected to the exhaust passage through an EGR passage having therein a normally closed EGR valve. Control means is provided for providing a control signal to disable the second cylinder unit when the engine load is below a predetermined value. The control signal is applied to valve drive means which thereby closes the stop valve and opens the EGR valve. The valve drive means is constructed to prevent the simultaneous opening of the stop and EGR valves.

6 Claims, 11 Drawing Figures

SPLIT TYPE INTERNAL COMBUSTION ENGINE

BACKGROUND OF THE INVENTION

1. Field of the Invention

This invention relates to improvements in an internal combustion engine of the split type operable on less than all of its cylinders when the engine load is below a given value.

2. Description of the Prior Art

It is known and desirable to increase the efficiency of a multicylinder internal combustion engine by reducing the number of cylinders on which the engine operates under predetermined engine operating conditions, particularly conditions of low engine load. Control systems have already been proposed which disable a number of cylinders in a multicylinder internal combustion engine by suppressing the supply of fuel to certain cylinders or by preventing the operation of the intake and exhaust valves of selected cylinders. Under given load conditions, the disablement of some of the cylinders of the engine increases the load on those remaining in operation and, as a result, the energy conversion efficiency is increased.

It is common practice to introduce exhaust gases into the disabled cylinders through an EGR valve adapted to open under given low load conditions and to prevent the introduced exhaust gases from flowing to the cylinders remaining in operation by the use of a stop valve adapted to close in timed relation with the opening of the EGR valve. This is effective to suppress pumping loss in the disabled cylinders and attain higher fuel economy.

With such conventional split type internal combustion engines, one difficulty has been assuring that the EGR and stop valves were operated at the proper timing. If any trouble occurs to open the EGR and stop valves simultaneously, a great amount exhaust gases will flow over the stop valve, causing many problems.

The present invention provides an improved split type internal combustion engine wherein means is provided for preventing the simultaneous opening of the stop and EGR valves.

SUMMARY OF THE INVENTION

The present invention provides an internal combustion engine which comprises first and second cylinder units each including at least one cylinder, an intake manifold divided into first and second intake passages leading to the first and second cylinder units, respectively, and an exhaust passage leading from the first and second cylinder units. The second intake passage and the exhaust passage are connected through an EGR passage which has therein a normally closed EGR valve. Control means is provided for providing a control signal to disable the second cylinder unit when the engine load is below a predetermined value. The control signal is applied to valve drive means which thereby closes the stop valve and opens the EGR valve. The valve drive means is constructed to prevent the simultaneous opening of the stop and EGR valves.

In a preferred embodiment, the valve drive means comprises a first pressure source maintained substantially at a first pressure, a second pressure source maintained substantially at second pressure different from the first pressure, a first valve actuator responsive to the first pressure for closing the EGR valve and responsive to the second pressure for opening the EGR valve, and a second valve actuator responsive to the first pressure for opening the stop valve and responsive to the second pressure for closing the stop valve. The valve drive means further comprises first valve means having a first port communicated with the first pressure source, a second port, and a third port connected to the first valve actuator, second valve means having a first port, a second port communicated with the second pressure source, and a third port connected to the second valve actuator, third valve means having a first port communicated with the first pressure source, a second port communicated with the second pressure source, and a third port communicted with the first valve means second port, and fourth valve means having a first port communicated with the first pressure source, a second port communicated with the second pressure source, and a third port communicated with the second valve means first port. The first valve means normally provides communication between its first and third ports and provides communication between its second and third ports in response to the control signal from the control means. The second valve means normally provides communication between its first and third ports and provides communication between its second and third ports in responsive to the control signal. The third valve means is associated with the stop valve to provide communication between its first and third ports when the stop valve opens and provide communication between its second and third ports when the stop valve closes. The fourth valve means is associated with the EGR valve to provide communication between its first and third ports when the EGR valve closes and provide communication between its second and third ports when the EGR valve opens.

BRIEF DESCRIPTION OF THE DRAWINGS

The present invention will be described in greater detail by reference to the following description taken in connection with the accompanying drawings, in which like reference numerals refer to the same or corresponding parts, and wherein.

DESCRIPTION OF THE PREFERRED EMBODIMENTS

Figure 1:
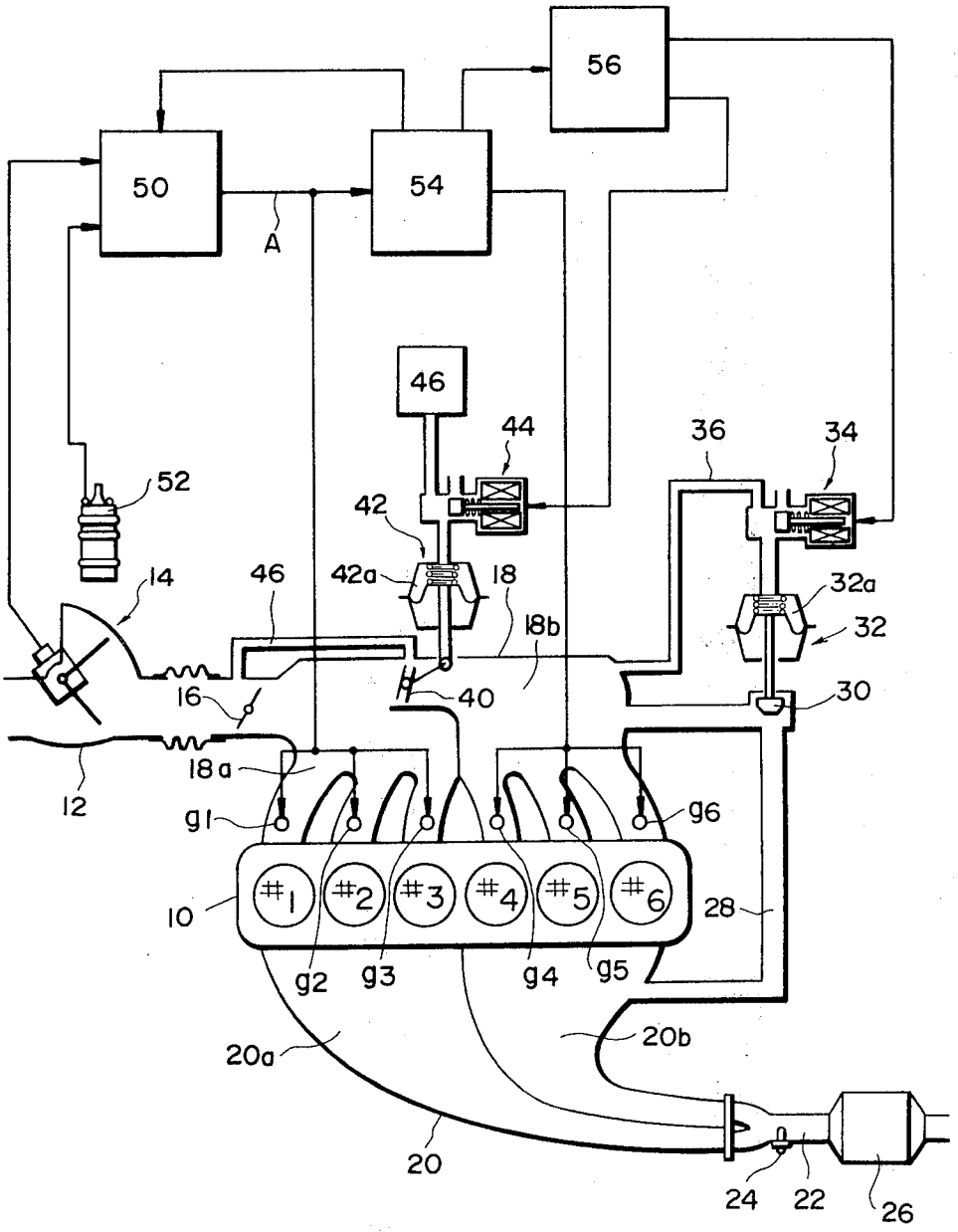
FIG. 1 (PRIOR ART)
FIG. 1 is a schematic sectional view showing a conventional split type internal combustion engine.

Prior to the description of the preferred embodiments of the present invention, we shall briefly describe the prior art split type internal combustion engine in FIG. 1 in order to specifically point out the difficulties attendant thereon.

Referring to FIG. 1, the reference numeral 10 designates an engine block containing therein an active cylinder unit including three cylinders #1 to #3 being always active and an inactive cylinder unit having three cylinders #4 to #6 being inactive when the engine load is below a predetermined value. Air is introduced to the engine through an air induction passage 12 provided therein with an airflow meter 14 and a throttle valve 16 drivingly connected to the accelerator pedal (not shown) for controlling the flow of air to the engine. The induction passage 12 is connected downstream of the throttle valve 16 to an intake manifold 18 which is divided into first and second intake passages 18*a* and 18*b*. The first intake passage 18*a* leads to the active cylinders #1 to #3 and the second intake passage 18*b* leads to the inactive cylinders #4 to #6.

The engine also has an exhaust manifold 20 which is divided into first and second exhaust passages 20*a* and 20*b* leading from the active cylinders #1 to #3 and the inactive cylinders #4 to #6, respectively. The exhaust manifold 20 is connected at its downstream end to an exhaust duct 22 provided therein with an exhaust gas sensor 24 and an exhaust gas purifier 26 located downstream of the exhaust gas sensor 24. The exhaust gas sensor 24 may be in the form of an oxygen sensor which monitors the oxygen content of the exhaust and is effective to provide a signal indicative of the air/fuel ratio at which the engine is operating. The exhaust gas purifier 26 may be in the form of a three-way catalytic converter which effects oxidation of HC and CO and reduction of NOx so as to minimize the emission of pollutants through the exhaust duct 22. The catalytic converter exhibits its maximum performance at the stoichiometric air/fuel ratio. In view of this, it is desirable to maintain the air/fuel ratio at the stoichiometric value.

An exhaust gas recirculation (EGR) passage 28 is provided which has its one end opening into the second exhaust passage 20*b* and the other end thereof opening into the second intake passage 18*b*. The EGR passage 28 has therein an EGR valve 30 which opens to permit recirculation of exhaust gases from the second exhaust passage 20*b* into the second intake passage 18*b* so as to minimize pumping losses in the inactive cylinders ·4 to #6 during a split engine mode of operation where the engine operates on the three cylinders. The EGR valve 30 closes to prevent exhaust gas recirculation during a full engine mode of operation where the engine operates on all of the cylinders #1 to #6.

The EGR valve 30 is driven by a first pneumatic valve actuator 32 which includes a diaphragm positioned within a casing to define therewith two chambers on the opposite sides of the diaphragm, and an operating rod having its one end centrally fixed to the diaphragm and the other end thereof drivingly connected to the EGR valve 30. The working chamber 32*a* is connected to the outlet of a first three-way solenoid valve 34 which has an atmosphere inlet communicated with atmospheric air and a vacuum inlet connected through a conduit 36 to the second intake passage 18*b*. The first solenoid valve 34 is normally in a position providing communication between the first valve actuator working chamber 32*a* and atmospheric air so as to close the EGR valve 30. During a split engine mode of operation, the first solenoid valve 34 is moved to another position where communication is established between the first valve actuator working chamber 32*a* and the second intake passage 18*b*, thereby opening the EGR valve 30.

The second intake passage 18*b* is provided at its entrance with a stop valve 40 normally opens to permit the flow of fresh air through the second intake passage 18*b* into the inactive cylinders #4 to #6. The stop valve 40 closes to block the fresh air flow to the inactive cylinders #4 to #6 during a split engine mode of operation. The stop valve 40 may be in the form of a double-faced butterfly valve having a pair of valve plates facing in spaced-parallel relation to each other. A conduit 46 is provided which has its one end opening into the induction passage 12 at a point upstream of the throttle valve 16 and the other end thereof opening into the second intake passage 18*b*, the other end being in registry with the space between the valve plates when the stop valve 40 is at its closed position. Air, which is substantially at atmospheric pressure, is introduced through the conduit 46 into the space between the valve plates so as to ensure that the exhaust gases charged in the second intake passage 18*b* cannot escape into the first intake passage 18*a* when the stop valve 40 closes.

The stop valve 40 is driven by a second pneumatic valve actuator 42 which is substantially similar to the first valve actuator 32. The working chamber 42*a* of the second valve actuaor 42 is connected to the outlet of a second three-way solenoid valve 44 which has an atmosphere inlet communicated with atmospheric air and a vacuum inlet connected to a vacuum tank 46. The second solenoid valve 44 is normally in a position providing communication between the second valve actuator working chamber 42*a* and atmospheric air so as to open the stop valve 40. When the engine operation is in a split engine mode, the first solenoid valve 44 is moved to another position where communication is established between the second valve actuator working chamber 42*a* and the vacuum tank 46 so as to close the stop valve 40.

The reference numeral 50 designates an injection control circuit which provides, in synchronism with engine speed such as represented by spark pulses from an ignition coil 52, a fuel-injection pulse signal of pulse width proportional to the air flow rate sensed by the airflow meter 14 and corrected in accordance with an air/fuel ratio indicative signal from the exhaust gas sensor 24. The fuel-injection pulse signal is applied directly to fuel injection valves $g_1$ to $g_3$ for supplying fuel to the respective cylinders #1 to #3 and also through a split engine operating circuit 54 to fuel injection valves $g_4$ to $g_6$ for supplying fuel to the respective cylinders #4 to #6. Each of the fuel injection valves $g_1$ to $g_6$ may be in the form of an ON-OFF type solenoid valve adapted to open for a period corresponding to the pulse width of the fuel-injection pulse signal.

The split engine operating circuit 54 determines the load at which the engine is operating from the pulse width of the fuel injection pulse signal. At high load conditions, the split engine operating circuit 54 permits the passage of the fuel-injection pulse signal from the injecion control circuit 50 to the fuel injection valves $g_4$ to $g_6$ and provides a high load indicative signal to a valve drive circuit 56. When the engine load falls below a given value, the split engine operating circuit 54 blocks the flow of the fuel-injection pulse signal from the injection control cirucit 50 to the fuel injection valves $g_4$ to $g_6$ and provides a low load indicative signal to the valve drive circuit 56.

The valve drive circuit 56 is responsive to the high load indicative signal from the split engine operating circuit 54 to hold the first and second three-way solenoid valves 34 and 44 in their normal positions so as to close the EGR valve 30 and open the stop valve 40. The valve drive circuit 56 is also responsive to the low load indicative signal from the split engine operating circuit 54 to change the positions of the first and second three-way solenoid valves 34 and 44, thereby opening the EGR valve 30 and closing the stop valve 40.

With such a conventional split type internal combustion engine, if any trouble occurs to open the EGR and stop valves 30 and 40 simultaneously, a great amount of exhaust gases will flow through the EGR valve 30 into the second intake passage 18*b* and hence through the stop valve 40 into the first intake passage 18*a*. This greatly reduces the suction vacuum in the intake manifold 18 downstream of the throttle valve 16. Since the brake booster is operated by the suction vacuum, the degree of braking becomes insufficient.

Figure 2:
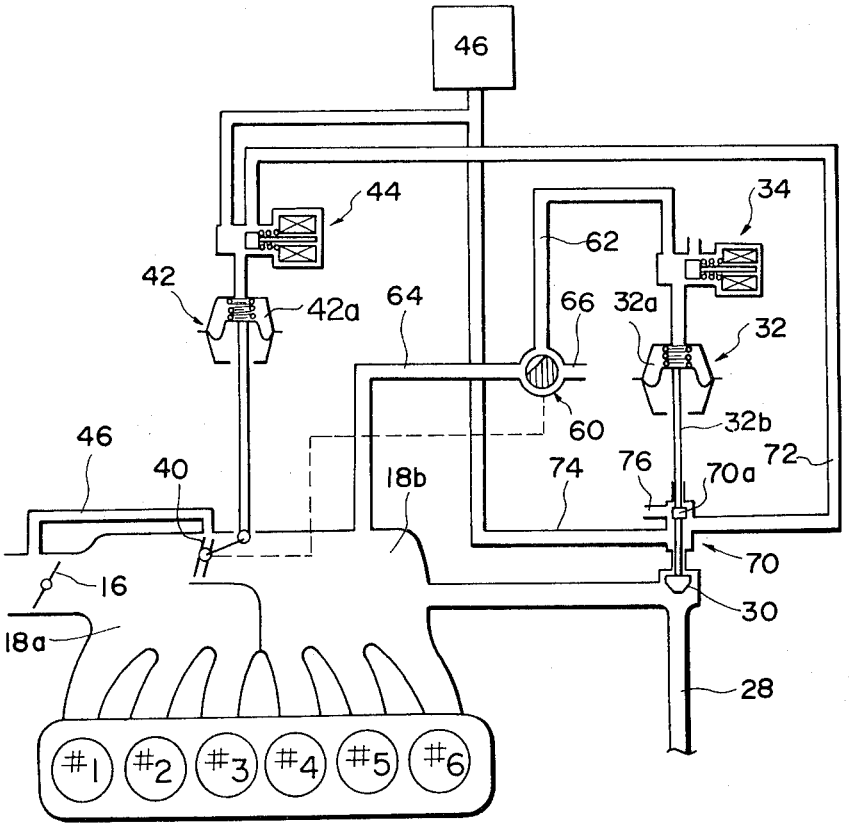
FIG. 2 is a schematic sectional view showing a significant portion of one embodiment of a split type internal combustion engine made in accordance with the present invention.
Figure 3:
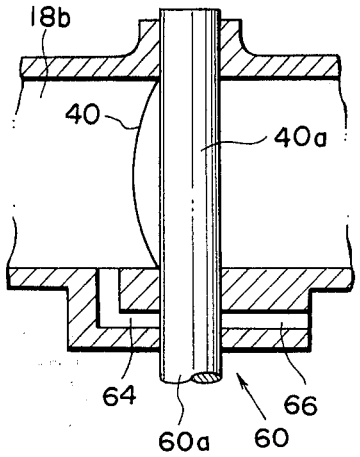
FIGS. 3, 4 and 5 are sectional views showing the three-way valve used in the engine of FIG. 2.
Figure 4:
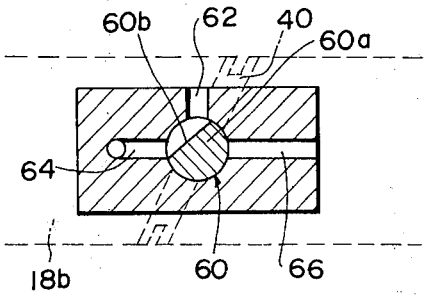

FIG. 2 illustrates a significant portion of one embodiment of a split type internal combustion engine made in accordance with the present invention. In this embodiment, a three-way valve 60 is provided which has an outlet port connected through a conduit 62 to the vacuum inlet of the first three-way solenoid valve 34, a vacuum port connected through a conduit 64 to the second intake passage 18*b*, and an atmosphere port connected through a conduit 66 to atmospheric air. The three-way valve 60 has a valve member 60*a* extending from the valve shaft 40*a* of the stop valve 40, as shown in FIG. 3, and having a cutout 60*b*. The valve member 60*a* is rotatable integrally with the stop valve 40 between its first and second positions. Upon the closure of the stop valve 40, the valve member 60*a* is in its first position where the cutout 60*b* provides communication between the conduit 62 and 64, as shown in FIG. 4, to communicate the vacuum inlet of the first three-way solenoid valve 34 with a vacuum.

Figure 5:
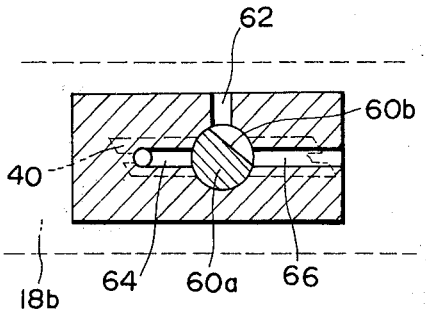

When the stop valve 40 opens, the valve member 60*a* rotates to its second position where the cutout 60*b* provides communication between the conduits 62 and 66, as shown in FIG. 5, to communicate the vacuum inlet of the first three-way solenoid valve 34 with atmospheric pressure. Accordingly, the first valve actuator working chamber 32*a* is always supplied with atmospheric pressure rather than vacuum so that the EGR valve 30 cannot open as long as the stop valve 40 opens even if any trouble occurs to change the first three-way solenoid valve 34 to the position providing communication between the conduit 62 and the first valve actuator working chamber 32*a*.

Another three-way valve 70 is provided which has an outlet port connected through a conduit 72 to the atmosphere inlet of the second three-way solenoid valve 44, a vacuum port connected through a conduit 74 to the vacuum tank 46, and an atmosphere port connected through a conduit 76 to atmospheric air. The three-way valve 70 has a valve member 70*a* mounted on the operating rod 32*b* of the first valve actuator 32. The valve member 70*a* is movable integrally with the EGR valve 30 between its first and second positions. Upon the closure of the EGR valve 30, the valve member 70*a* is in its first position providing communication between the conduits 72 and 76 to introduce atmospheric pressure into the atmosphere inlet of the second three-way solenoid valve 44.

When the EGR valve 30 opens, the valve member 70*a* moves upward to its second position where communication is provided between the conduits 72 and 74 to introduce a vacuum to the atmosphere inlet of the second three-way solenoid valve 44. Accordingly, the second valve actuator working chamber 42*a* is always supplied with vacuum rather than atmospheric pressure so that the stop valve 40 cannot open as long as the EGR valve 30 opens even if any trouble occurs to change the second three-way solenoid valve 44 to the position providing communication between its outlet and its atmospheric inlet.

That is, the three-way valve 60 prevents the EGR valve 30 from opening while the stop valve 40 opens and the three-way valve 70 prevents the stop valve 40 from opening while the EGR valve 30 opens. This is effective to prevent the simultaneous opening of the EGR and stop valves even if any trouble occurs on the three-way solenoid valves 34 and 44. As a result, there is no possibility of exhaust gases flowing through the EGR and stop valve 30 and 40 to greatly reduce the suction vacuum in the intake manifold downstream of the throttle valve 16. Thus, the degree of braking is maintained sufficient.

The simultaneous opening of the EGR and stop valves 30 and 40 may be prevented by controlling the drive circuit 56 based upon the position of the EGR and stop valves sensed electrically.

Figure 6:
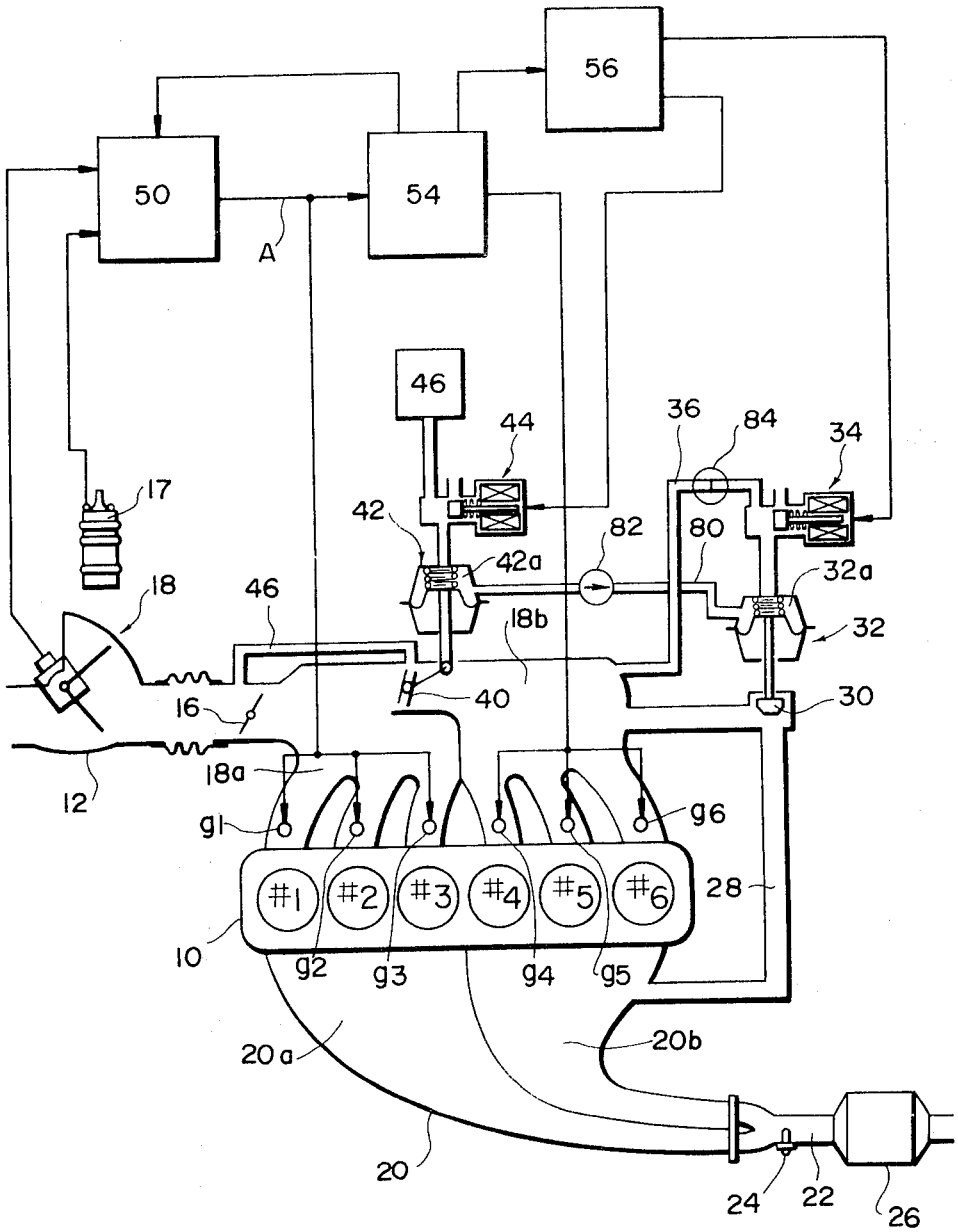
FIG. 6 is a schematic sectional view showing a second embodiment of the present invention.

Referring to FIG. 6, there is illustrated a second embodiment of the present invention wherein the first and second valve actuator working chambers 32*a* and 42*a* are connected through a conduit 80 having therein a check valve 82. The check valve 82 is adapted to allow fluid flow only in the direction from the second valve actuator working chamber 42*a* to the first valve actuator working chamber 32*a*. In this embodiment, the conduit 36 has therein a restricted orifice 84.

It is assumed that the second valve actuator working chamber 42*a* is pierced with a hole through which atmospheric air is introduced thereinto and, as a result, the stop valve 40 remains open. The introduced atmospheric air flows through the check valve 82 to the first valve actuator working chamber 32*a*. Because of the presence of the restricted orifice 84, the degree of the vacuum introduced from the second intake passage 18*b* through the conduit 36 into the first valve actuator working chamber 32*a* is rather smaller than the degree of the atmospheric pressure introduced through the conduit 80 into the first valve actuator working chamber 32*a*. Accordingly, the first valve actuator working chamber 32*a* is held substantially at atmospheric pressure so as to force the EGR valve 30 to close even though the engine operation is in a split engine mode.

It is to be noted that the check valve 82 assures the same operation as effected with the arrangement of FIG. 1 when the second valve actuator working chamber 42*a* is subject to no failure.

Figure 7:
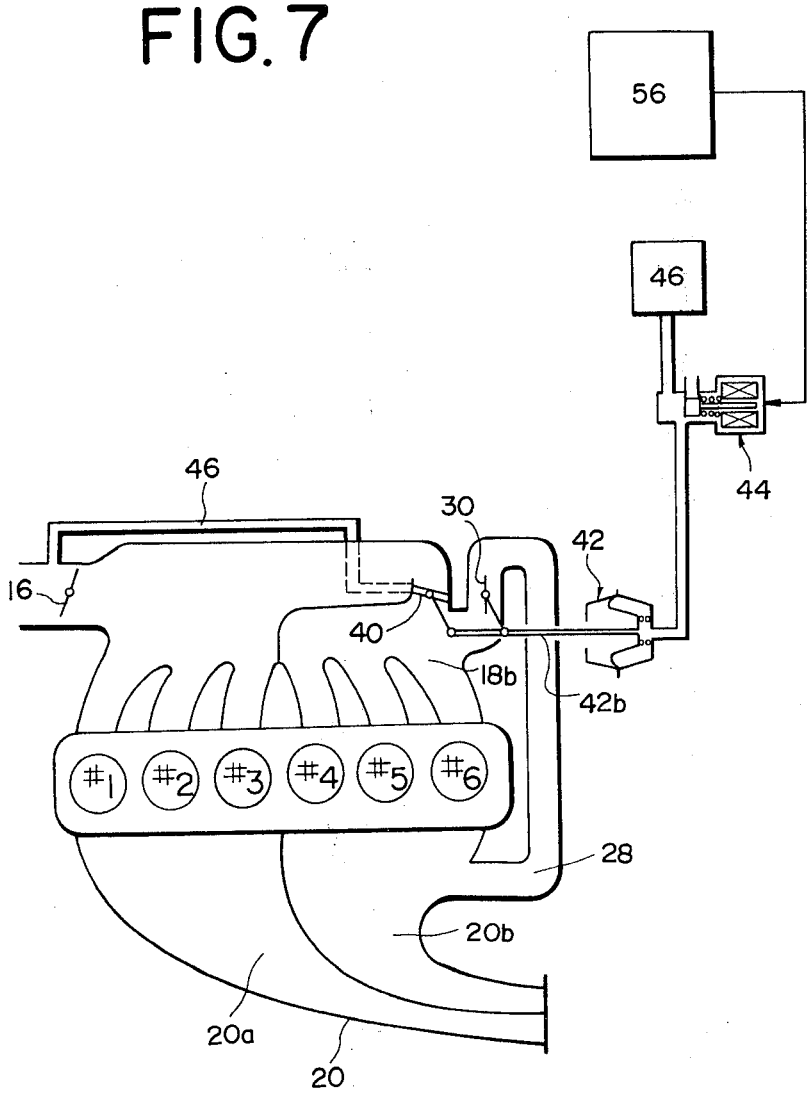
FIG. 7 is a schematic sectional view showing a third embodiment of the present invention.
Figure 8:
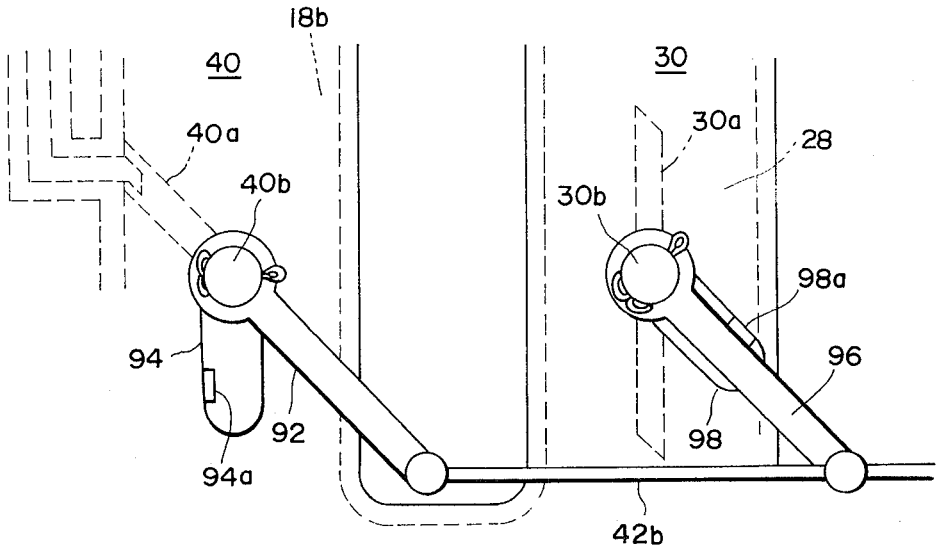
FIGS. 8, 9 and 10 are plan views showing the valve drive mechanism used in the engine of FIG. 7.
Figure 11:
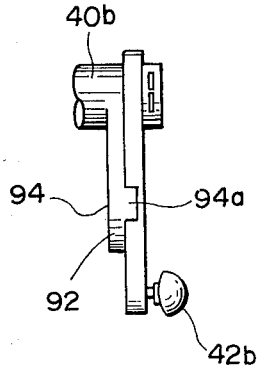
FIG. 11 is a side view showing the valve drive mechanism.

Referring to FIG. 7, there is illustrated a third embodiment of the present invention wherein the EGR valve 30 is drivingly connected to the operating rod 42*b* of the second valve actuator 42 so that the EGR and stop valves 30 and 40 can be moved integrally. As shown in FIG. 8, the operating rod 42*b* has first and second levers 92 and 96 rotatably mounted at their one ends thereto. The other end of the first lever 92 is rotatably mounted to the stop valve shaft 40*b* to which a first arm 94 is fixedly secured. The other end of the second lever 96 is rotatably mounted to the EGR valve shaft 30*b* to which a second arm 98 is fixedly secured. As shown in FIG. 11. the first arm 94 has a projection for engagement with the first lever 92. The second arm 98 is substantially similar in structure to the first arm 94. In the position shown in FIG. 8, the EGR valve 30 is open and the stop valve 40 is closed.

Figure 9:
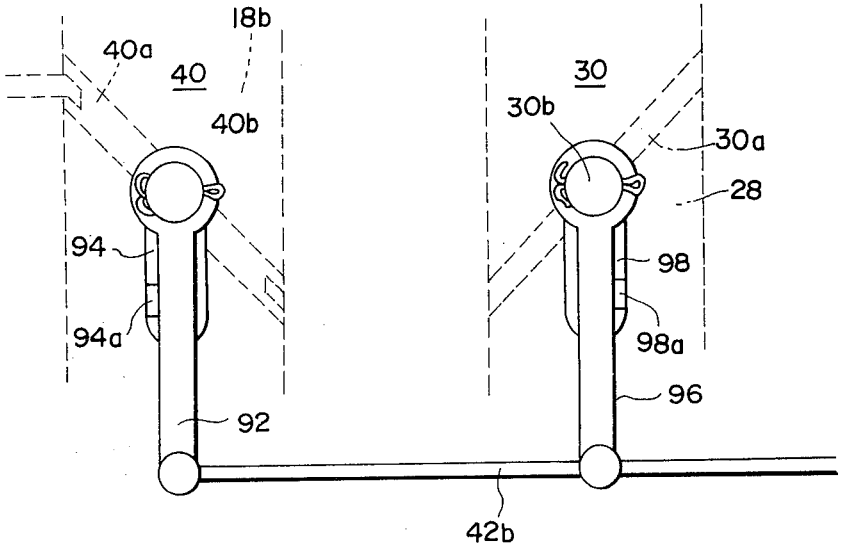

When the operating rod 42*b* is moved to the left in the drawing from the position shown in FIG. 8, the first lever 92 rotates about the valve shaft 40*b* in a clockwise direction into abutment with the projection 94*a*. Simultaneously, the second lever 96 rotates about the valve shaft 30*b* in the clockwise direction. The second arm 98 rotates along with the second lever 96 under the force of a return spring (not shown) to close the EGR valve 30. This is shown in FIG. 9.

Figure 10:
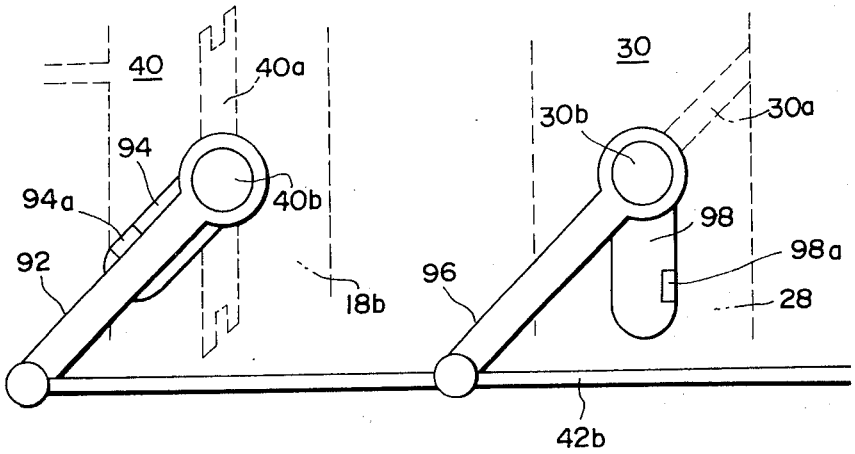

When the operating rod 42*b* is moved further to the left, the first lever 92 pushes the projection 94*a* and rotates the first arm 94 to open the stop valve 40. Simultaneously, the second lever 96 rotates in the clockwise direction away from the second arm 98 held in the position. This is shown in FIG. 10 where the EGR valve 30 is closed and the stop valve 40 is open.

It will be readily understood from the foregoing how the above arrangement operates upon the rightward movement of the operating rod 42*b*. In addition, it will be readily understood that the arrangement prevents the simultaneous opening of the EGR and stop valves 30 and 40.

While the present invention has been described in connection with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine comprising:

(a) first and second cylinder units each including at least one cylinder;

(b) an intake manifold having therein a throttle valve, said intake manifold being divided downstream of said throttle valve into first and second intake passages respectively communicating with said first and second cylinder units, said intake manifold second intake passage having therein a stop valve near its entrance;

(c) an exhaust passage;

(d) an EGR passage connected from said exhaust passage to said intake manifold second intake passage for recirculating engine exhaust gases into said intake manifold second intake passage, said EGR passage having therein an EGR valve;

(e) control means for providing a control signal and for disabling said second cylinder unit when the engine load is below a predetermined value;

(f) valve drive means responsive to the control signal from said control and disabling means for closing said stop valve and opening said EGR valve, said valve drive means adapted to prevent the simultaneous opening of both of said stop and EGR valves and including:

(1) a first vacuum source;

(2) a second vacuum souce;

(3) a pressure source whose pressure is higher than that of the first and second vacuum sources;

(4) a first valve actuator having a working chamber;

(5) a conduit for connecting said working chamber to said first vacuum source through a restriction orifice;

(6) said first valve actuator being operable to close said EGR valve when said first valve actuator working chamber is communicated with said pressure source and to open when said first valve actuator working chamber is communicated with said first vacuum source through said restriction orifice;

(7) a second valve actuator having a working chamber, said second valve actuator being operable to open said stop valve when said second valve actuator working chamber is communicated with said pressure source and to close said stop valve when said second valve actuator working chamber is communicated with said second vacuum sources;

(8) a first valve responsive to the control signal from said control and disabling means to communicate said first valve actuator working chamber with said first vacuum source through said restriction orifice, said first valve being operable to communicate said first valve actuator working chamber with said pressure source in the absence of the control signal;

(9) a second valve responsive to the control signal from said control and disabling means to communicate said second valve actuator working chamber with said second vacuum source, said second valve being operable to communicate said second valve actuator working chamber with said pressure source in the absence of the control signal;

(10) a conduit connected from said first valve actuator working chamber to said second valve actuator working chamber, said conduit having therein a check valve for permitting flow from said second valve actuator working chamber to said first valve actuator working chamber but note vice versa.

2. The internal combustion engine of claim 1, wherein said first valve has first, second and third ports, said first port communicating with said first valve actuator working chamber, said second port communication with said pressure source, said third port being connected to said first vacuum source through said conduit having therein said restriction orifice, said first valve being in a position providing communication between said first and second ports in the absence of the control signal from said control means, said first valve being responsive to the control signal to shift to another position providing communication between said first and third ports.

3. The internal combustion engine of claim 2, wherein said first valve communicates said first valve actuator working chamber with said intake manifold second intake passage through said restriction orifice in the presence of the control signal from said control and disabling means.

4. The internal combustion engine of claim 2, wherein said first valve communicates said first valve actuator working chamber with atmospheric air in the absence of the control signal from said control and disabling means and wherein said second valve communicates said second valve actuator working chamber with atmospheric air in the absence of the control signal from said control and disabling means.

5. The internal combustion engine of claim 1, wherein said first valve communicates said first valve actuator working chamber with said intake manifold second intake passage through said restriction orifice in the present of the control signal from said control and disabling means.

6. The internal combustion engine of claim 1, wherein said first valve communicates said first valve actuator working chamber with atmospheric air in the absence of the control signal from said control and disabling means and wherein said second valve communicates with second valve actuator working chamber with atmospheric air in the absence of the control signal from said control and disabling means.

* * * * *